US006474193B1

(12) United States Patent
Farney

(10) Patent No.: US 6,474,193 B1
(45) Date of Patent: Nov. 5, 2002

(54) PEDAL CRANK

(75) Inventor: Michael Kent Farney, Broken Arrow, OK (US)

(73) Assignee: Sinties Scientific, Inc., Tulsa, OK (US)

( * ) Notice: Subject to any disclaimer, the term of this patent is extended or adjusted under 35 U.S.C. 154(b) by 0 days.

(21) Appl. No.: 09/535,929

(22) Filed: Mar. 24, 2000

Related U.S. Application Data

(60) Provisional application No. 60/126,491, filed on Mar. 25, 1999.

(51) Int. Cl.[7] ..... G05G 1/16
(52) U.S. Cl. ..... 74/594.3
(58) Field of Search ..... 74/594.1–594.7, 74/560, 562; 280/227

(56) References Cited

U.S. PATENT DOCUMENTS

| | | | | | |
|---|---|---|---|---|---|
| 550,206 | A | * | 11/1895 | Tompkins | 74/594.3 |
| 571,793 | A | * | 11/1896 | Rau | 74/594.3 |
| 1,714,134 | A | * | 5/1929 | Poyser | 74/594.3 |
| 4,281,845 | A | * | 8/1981 | Brown | 74/594.3 |
| 4,807,491 | A | | 2/1989 | Stuckenbrok | |
| 4,960,013 | A | * | 10/1990 | Sander | 74/594.3 |
| 5,188,003 | A | * | 2/1993 | Trammell, Jr. | 74/594.3 |
| 5,261,294 | A | | 11/1993 | Ticer et al. | |
| 5,879,017 | A | * | 3/1999 | Debruin | 74/594.3 |
| 6,276,234 | B1 | * | 8/2001 | Harrington | 74/594.3 |

FOREIGN PATENT DOCUMENTS

| | | | | |
|---|---|---|---|---|
| FR | 871327 | * | 4/1942 | 74/594.3 |

* cited by examiner

*Primary Examiner*—Chong H. Kim
(74) *Attorney, Agent, or Firm*—Fellers, Snider, Blankenship, Bailey & Tippens, P.C.

(57) ABSTRACT

The pedal crank of the present invention includes a cam having a channel therein, a hub fixed to the shaft of the exercise machine, an arm operable with a cam follower and a pair of rods. The arm includes the pedal or other force applying member of the exercise machine, and the cam follower extends into the channel of the cam. The rods extend from the hub to the arm such that the distance between the hub and the arm may vary according to the length of the rods. The shaft of the exercise machine extends through an eccentric hole in the cam. A pair of channels are machined in either the hub or the arm in which the rods reciprocate. The pedal crank is capable of extension to a maximum length of the rods which corresponds to the range of maximum biomechanical force applied to the leg of the user to the pedal or other force applying member of the exercise machine. The pedal crank then retracts in length on rotation to a point corresponding to the minimum biomechanical force. In this way, the maximum force benefit is achieved while leg/knees stress is reduced over the range of motion when compared to traditional fixed length pedal cranks.

9 Claims, 10 Drawing Sheets

PEDAL CRANK

This invention relates to pedal cranks and pedal crank drive mechanisms for stationary and transportation bicycle applications and claims benefit of prior filed copending Provisional Application No. 60/126,491, filed Mar. 25, 1999.

BACKGROUND OF THE INVENTION

Field of the Invention

Bicycles, both transportation and stationary, have traditionally included pedal cranks of a fixed length wherein the pedal rotates around the axle in a circular path determined by the length of the pedal crank. However, due to the physiology of the human body, this circular path fails to maximize the biomechanical forces of the legs of the person pedaling the bicycle. This results in wasted energy, fatigue, and excessive wear on the knees, and ankles.

In addition, many people use bicycles, and particularly stationary bicycles as a means of obtaining a cardiovascular workout or for rehabilitation purposes following an injury. It has been found, however, that a full cardiovascular benefit is not achieved due to the fact that the leg muscles of the user prematurely fatigue requiring the user to rest. In the case of rehabilitation after an injury, a particular muscle group or joint, such as the top of the thigh or knee fatigue or become sore before maximum benefit is achieved.

A need, therefore, exists for a pedal crank that matches the biomechanical forces of the human legs such that less energy is expended allowing all used muscle groups to fatigue at a more even rate after the maximum cardiovascular benefit for that exercise is achieved.

Devices for varying the length or altering the path of the pedal crank have been tried with little success. Such devices are either too heavy or cumbersome or cannot withstand the stresses resulting from the required repetitive motion. A need, therefore, also exists for a pedal crank that alters the path of travel from traditional fixed length pedals which is strong enough to endure heavy use without being heavy or cumbersome.

SUMMARY OF THE INVENTION

The pedal crank of the present invention is capable of extension to a maximum length which corresponds to the range of maximum biomechanical force applied by the leg of the user to the pedal of an exercise machine. The pedal crank then retracts in length on rotation to a point corresponding to the minimum biomechanical force. In this way, the maximum benefit is achieved while leg/knee stress is reduced over the range of motion when compared to traditional fixed length pedal cranks.

It has been found that the pedal energy expended by a user of the pedal crank of the present invention is 15% less than the energy expended by a user of a pedal crank of fixed length. In this way, leg stress and fatigue is reduced allowing the user to obtain a longer, more extensive cardiovascular workout at a higher or sustained heart rate because leg fatigue is substantially reduced.

The pedal crank assembly of the present invention includes, generally, a cam, hub, arm, cam follower, and a pair of rods. The pedal crank may be used with different types of exercise machines which turn a central rotating shaft. Such machines primary include bicycles, stationary and ambulatory, but also may include other devices such as elliptical machines.

The cam is secured to the exercise machine and includes a channel therein. The channel may be annular or may be of another geometry where a different path of travel is desired.

The cam also includes a hole for the shaft of the exercise machine to extend through. This hole may be eccentric from the center point of the channel or concentric.

The arm includes the pedal or other force applying member of the exercise machine. The cam follower engages the channel in the cam and travels therein. The cam follower is operable with the arm such that as the arm is driven by the face applied to the pedal or other such member, the arm drives the cam follower within the channel.

A pair of rods extend from the hub to the arm. Each rod has a length such that the distance between the hub and the arm is varied by the length of the rods.

In a first preferred embodiment, the rods are fixed in the arm at their first end. Channels are machined through the hub to receive the second end of the rods such that the rods are capable of reciprocating within the channels.

As the arm drives the cam follower around the channel in the cam, the eccentric hole in the cam through which the shaft extends causes the distance between the arm and the hub to vary. The rods thus reciprocate within the channels of the hub and also rotate the hub, and therefore, the shaft. A linear bearing is inserted in the channels of the hub in which the rods reciprocate.

In a second preferred embodiment, the second ends of the rods are fixed in the hub. Channels are cut in the arm to receive the first ends of the rods. The rods thus reciprocate within the channels of the arm as the assembly is rotated. A linear bearing is inserted in the channels of the arm between the arm and the rods.

In a third preferred embodiment, the cam includes a ring with a plate inside. The plate is round such that the ring rotates around the circumference of the plate when the plate is fixed to the exercise machine. A plurality of roller bearings are fixed within the ring to rotate around the circumference of the plate.

The plate includes an eccentric hole to receive the shaft of the exercise machine. A hub is fixed to the shaft and capable of rotation therewith. The arm, cam follower and rods are configured as described above with regard to the first and second preferred embodiment with the exception that the cam follower is fixed within a hole in the ring. In this embodiment, the cam follower rotates the ring around the plate. The fact that the hole in the plate is eccentric causes the distance between the hole and the hole in the ring to change as the ring rotates around the plate. This distance change causes the rods to reciprocate within either the hub or the arm depending upon which includes the channels.

It is an object of the present invention to provide a pedal crank that maximizes the biomechanical forces of the human leg preventing localized premature fatigue of specific muscle groups thereby allowing a more complete workout for the same expended energy.

It is a further object of the present invention to provide such a pedal crank which varies in length over its rotation.

Another object of the present invention is to provide such a pedal crank which is light in weight, cost effective to manufacture yet durable enough to withstand heavy use.

Other objects and advantages of the invention will become apparent upon reading the following detailed description and upon reference to the drawings.

DETAILED DESCRIPTION OF THE PREFERRED EMBODIMENT

Figure 1:
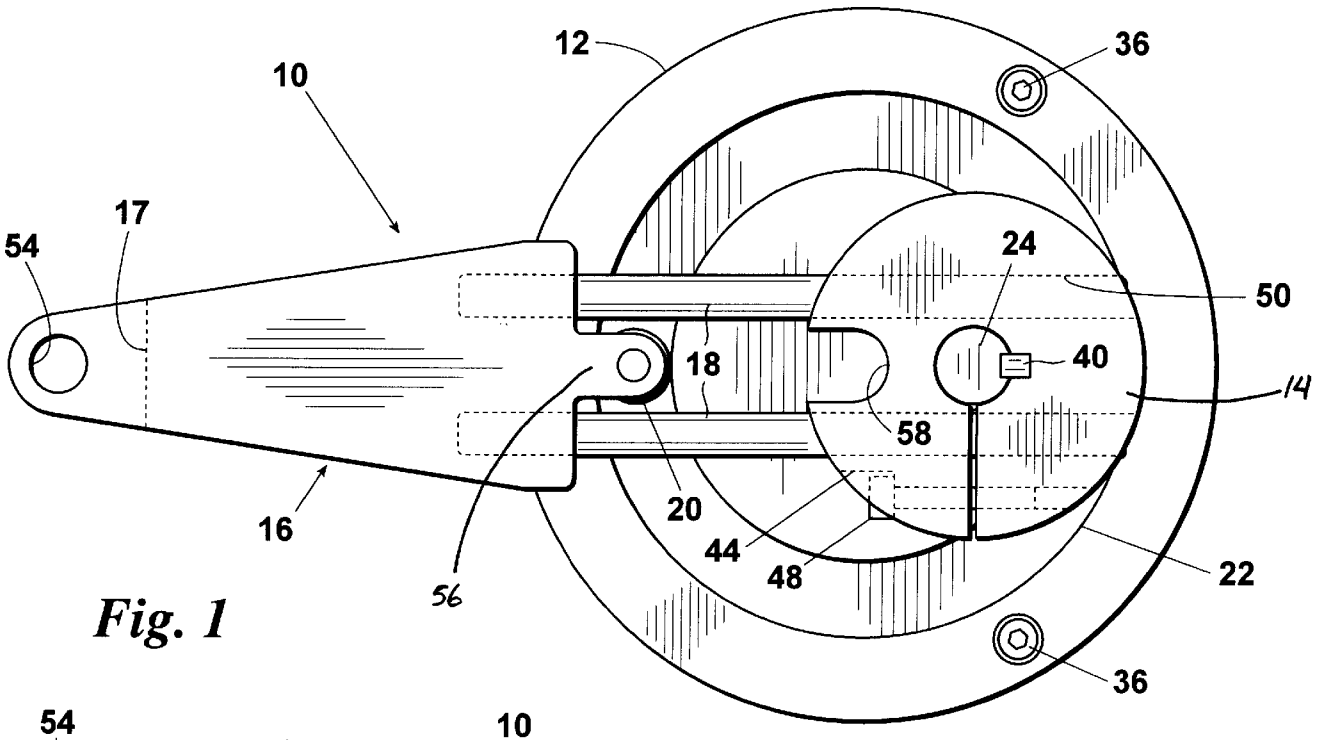
FIG. 1 is a side view of the pedal crank of the present invention.

FIG. 1 depicts the pedal crank apparatus 10 of the present invention. Pedal crank 10 includes in the preferred embodiment, cam 12, hub 14, arm 16, connecting rods collectively 18 and cam follower 20.

Arm 16 is capable of reciprocation wherein rods 18 slide within hub 14 as arm 16 rotates around cam 12. Cam follower 20 affixed to arm 16 rotates within a channel 22 within cam 12. Hub 14 is fixed to an axle 24 which extends through cam 12 at a point eccentric from the center of cam 12. In this way, the length of the arm 16, rod 18, hub 14 assembly varies from a maximum length to a minimum length as it rotates around cam 12 as will be discussed further below.

Figure 2:
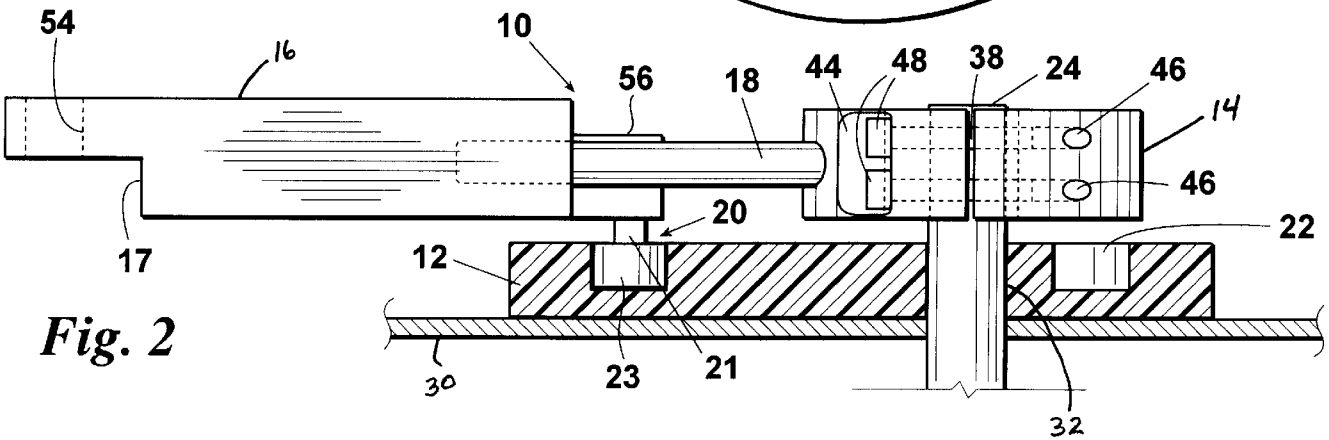
FIG. 2 is a top, partial cut-away view of the pedal crank of FIG. 1.

FIG. 2 depicts pedal crank 10 from a top view wherein cam 12 is partially cut away. In this view, the spatial relationships between cam 12, hub 14, arm 16, rods 18, and cam follower 20 can be better understood.

Figure 4:
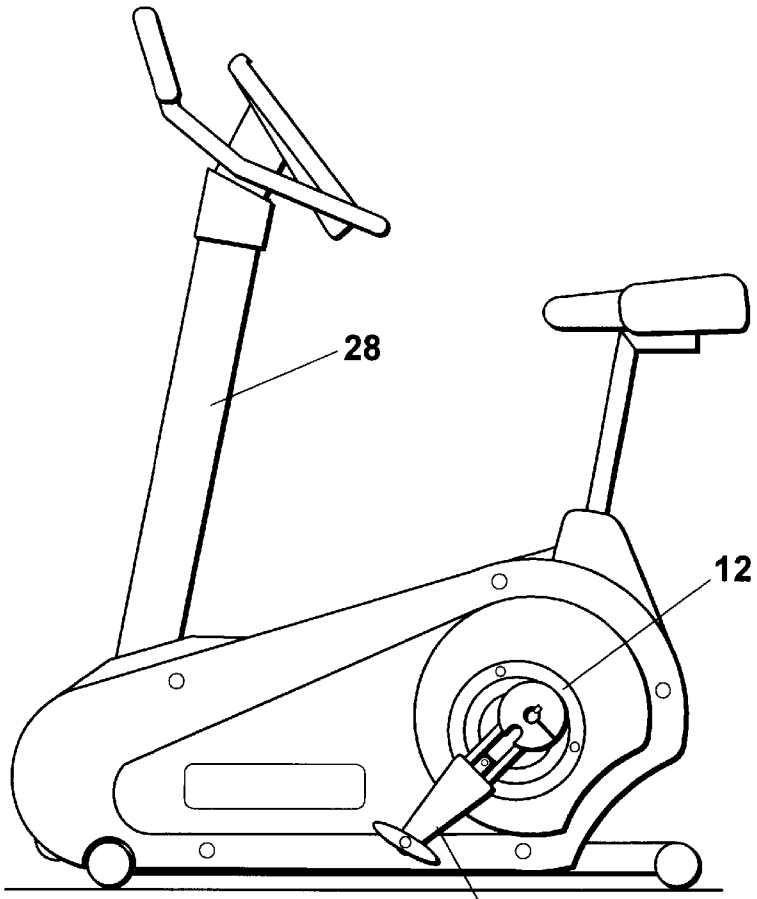
FIG. 4 is a side view of a upright stationary exercise bicycle including the pedal crank of the present invention.
Figure 3:
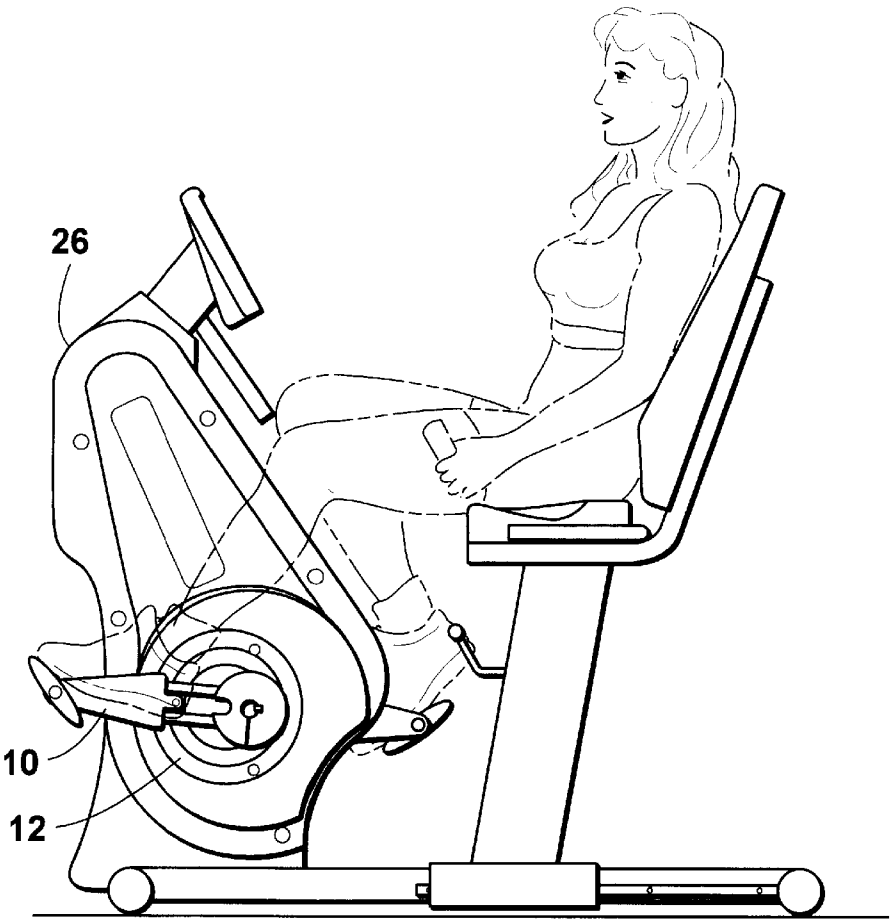
FIG. 3 is a side view of a recumbent stationary exercise bicycle including the pedal crank of the present invention.

Pedal crank 10 may be installed and is useful on any type of known pedal drive system and may be adapted for transportation and stationary bicycle applications as well as elliptical and other exercise equipment. As shown in FIGS. 3 and 4, pedal crank 10 is particularly suitable for stationary bicycle applications where it is desirable to obtain the maximum cardiovascular workout while placing the minimum stress on the legs, and particularly the knees of the user. Pedal crank 10 is further particularly suited for rehabilitation applications where it is desirable to increase endurance, muscle fitness, and/or cardiovascular fitness while placing the minimal amount of stress on the patient.

FIG. 3 depicts pedal crank 10 installed on a recumbent stationary exercise bicycle while FIG. 4 depicts pedal crank 10 installed on an upright stationary exercise bicycle. Pedal crank 10 is equally suited for either application, however, the mounting of pedal crank 10 will vary depending upon the application. For example, for the recumbent application of FIG. 3, pedal crank 10, and particularly cam 12 will be affixed to recumbent exercise bicycle 26 such that the maximum extension of the length of pedal crank 10 will occur at approximately 5° above horizontal forward of the crank. When pedal crank 10 is installed on an upright exercise bicycle 28 of FIG. 4, it has been found that it is acceptable to install cam 12 of pedal crank 10 to exercise bicycle 28 at a position where the maximum extension of pedal crank 10 will occur at 45° below horizontal forward of the crank. These enumerated angles are for the purpose of exemplification only and may vary dependant upon the application. The purpose of the variation and installation of pedal crank 10 to the various types of devices is so as to maximize the biomechanical motion of the position of the user with regard to the particular selected piece of equipment. The proper installation position will be determined specifically for each piece of equipment.

Figure 5:
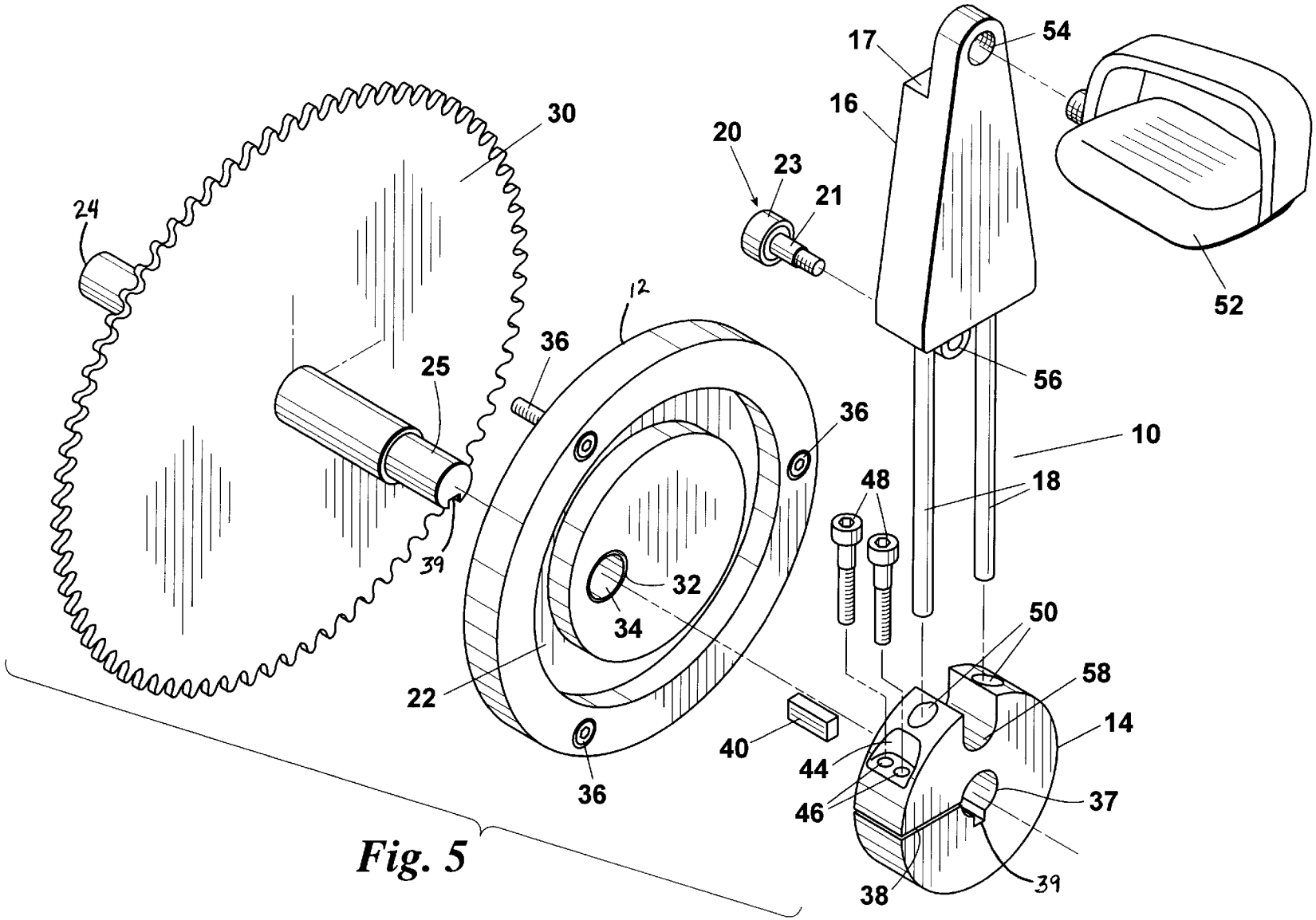
FIG. 5 is an exploded isometric view of the pedal crank of the present invention oriented in relation to a sprocket, axle and pedal of a traditional stationary bicycle.

Referring next to FIG. 5 which is an isometric exploded view of the pedal crank 10 of the present invention. Axle 24 and a sprocket 30 are also shown in order to convey their respective orientations. In most stationary bicycle applications, sprocket 30 is positioned so as to substantially bisect the length of axle 24 and includes teeth along its circumference to receive a chain. The chain (not shown) generally extends around a second, typically smaller, sprocket typically connected to a braking mechanism or a rear wheel in the case of an ambulatory bicycle. Such assemblies are known in the art. Cam 12, including channel 22 and eccentric hole 34 is slid onto axle 24 adjacent sprocket 30.

Figure 7:
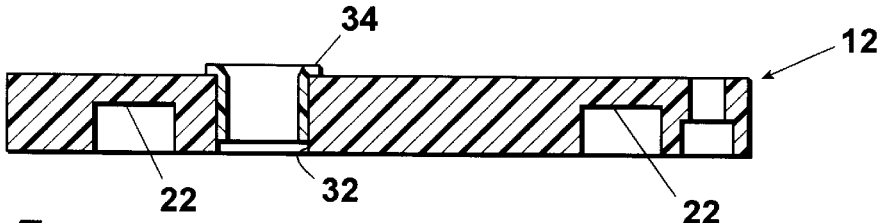
FIG. 7 is a cut-away side view taken along line 7—7 of FIG. 6.
Figure 6:
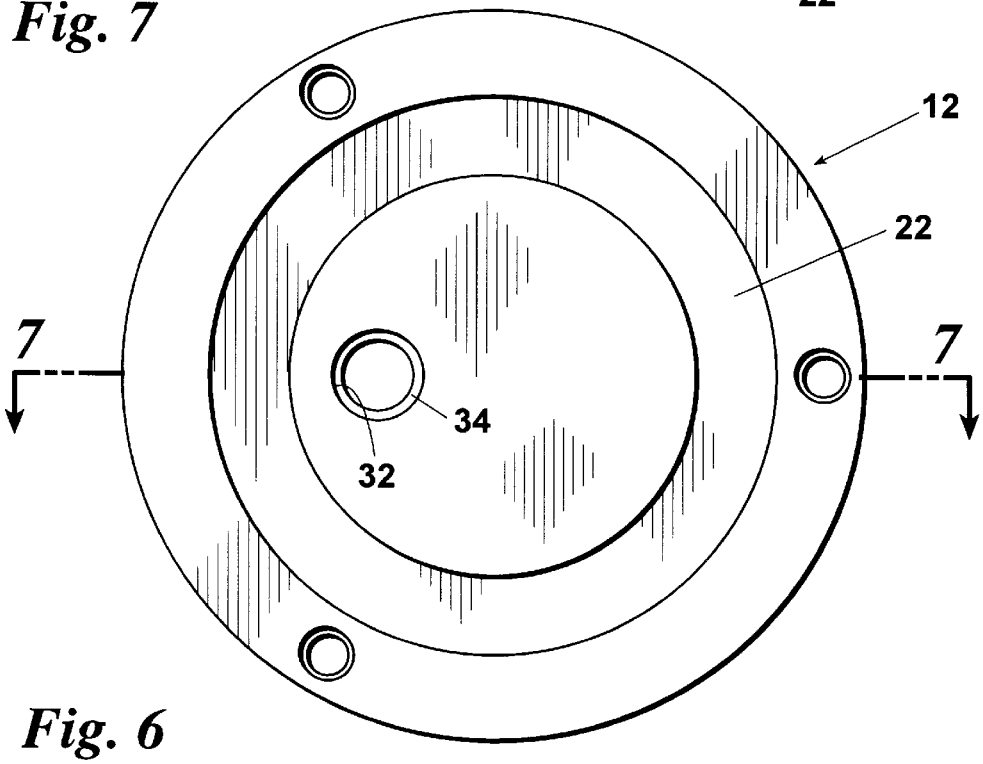
FIG. 6 is a front view of the cam of the pedal crank of the present invention.

Cam 12 in the preferred embodiment includes a bearing 34 press fit into eccentric hole 32. Bearing 34 allows smooth rotation between shoulder 25 of axle 24 within eccentric hole 32 of cam 12. Although linear bearings, commercially available are particularly suited for this application, it is understood that other types of bearings may be substituted. Linear bearing 34, as well as cam 12 are shown in greater detail in FIGS. 6, and 7.

Cam 12 is secured to the frame of the bike through the use of a plurality of machine screws or bolts collective 36. Machine screws 36 are countersunk in cam 12. As can be seen, in this embodiment, cam 12 remains in a fixed position in relation to axle 24, hub 14, arm 16, and cam follower 20.

As cam 12 is installed onto axle 24, a shoulder 25 of reduced diameter of axle 24 extends beyond cam 12 to receive hub 14. Accordingly, cam 12 is positioned flush against sprocket 30 with axle 24 and particularly shoulder 25 extending therefrom. Hub 14 includes a concentric hole 37 therein and a slot 38 is machined in hub 14 from its circumference into hole 37. Both shoulder 25 and hole 37 include a groove or key way 39 of mating dimensions such that when hub 14 is installed onto shoulder 25 a key way 39 is formed of a shape precisely matching the shape of a key 40 press fit therein. Key 40 insures that axle 24 and hub 14 rotate in unison.

Figure 9:
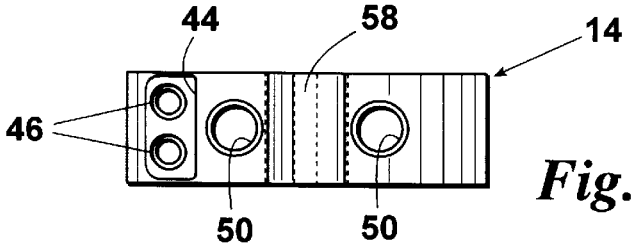
FIG. 9 is a top view of the hub of FIG. 8.
Figure 10:
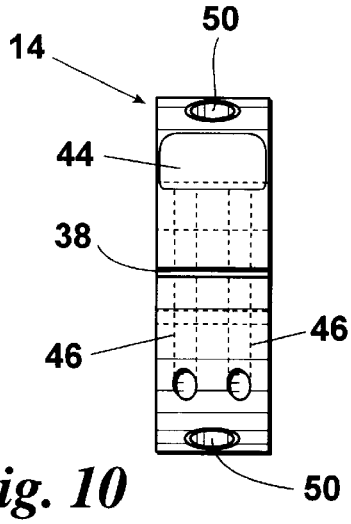
FIG. 10 is a side view of the hub of FIG. 9.
Figure 8:
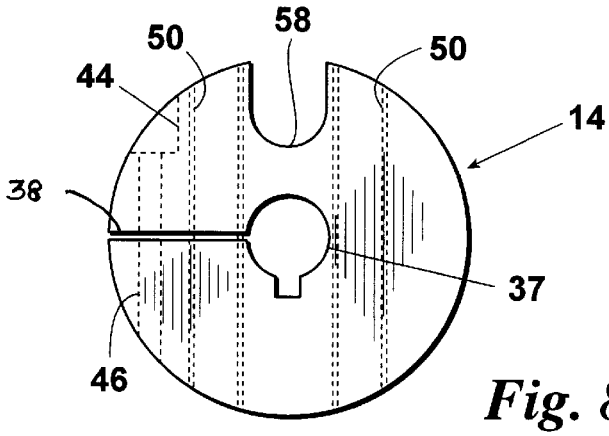
FIG. 8 is a side view of the hub of the pedal crank of the present invention with the rod channels, and set screw holes shown in phantom.

Hub 14 is more particularly disclosed in FIGS. 8–10 taken in conjunction with FIG. 5. As shown in phantom in FIG. 8, a recess 44 is machined in the circumference of hub 14 and a pair of holes are drilled and tapped from recess 44 through slot 38. Holes 46 are threaded to mate the threads of set screws 48 (FIG. 5) such that when socket head cap screws 48 are threaded into holes 46, the heads of screws 48 are countersunk into the circumference of hub 14 in recess 44. As screws 48 are tightened within holes 46, the portions of hub 14 divided by slot 38 are drawn together such that the width of slot 38 is reduced. When the width of slot 38 is reduced, the diameter of hole 37 is correspondingly reduced such that hub 14 is clamped onto shoulder 25 of axle 24 securing it thereon. A plurality of cylindrical channels collectively 50 are machined through hub 14. Cylindrical channels 50 receive rods 18 (FIG. 5). A linear bearing may be inserted into each channel 50 to facilitate reciprocation of rods 18 within channels 50 during rotation of pedal crank 10.

The orientation of rods 18 with respect to hub 14 can be seen when referring back to FIG. 5. The first ends of rods 18 are fixed/secured within arm 16. Arm 16 receives cam follower 20 and also a foot pedal 52. Foot pedals such as foot pedal 52 are known in the art.

Figure 11:
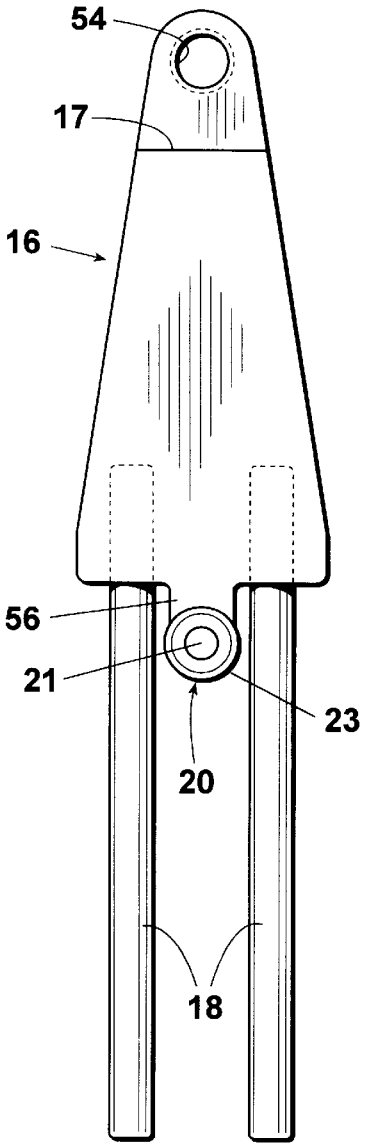
FIG. 11 is a front view of the crank arm and rod assembly including the roller bearing of the cam follower.
Figure 12:
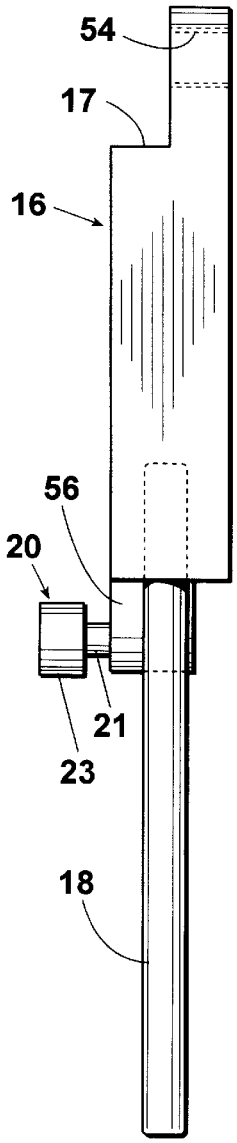
FIG. 12 is a side view of the crank arm and rod assembly of FIG. 11.
Figure 13:
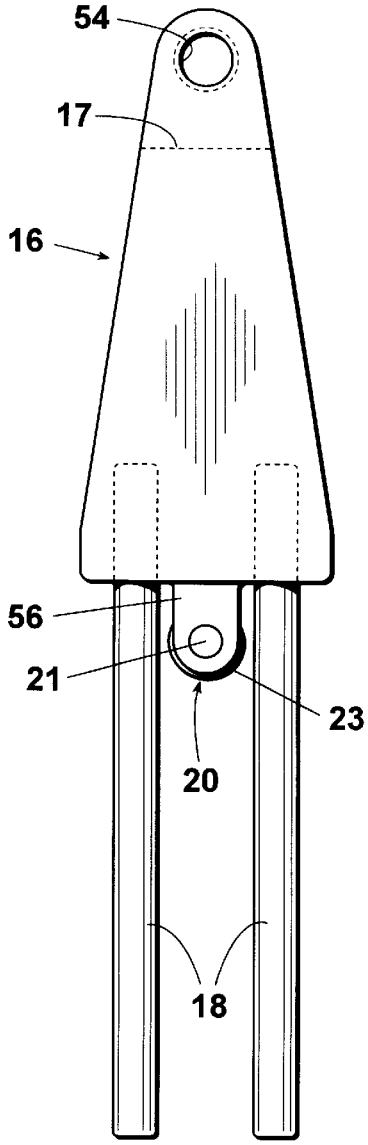
FIG. 13 is a back view of the crank arm and rod assembly of FIG. 11.

The arm/rod assembly is shown in FIGS. 11–13. FIGS. 11–13 depicts the first ends of rods 18 fixed within arm 16. Arm 16 includes a notch 17 machined therein to which pedal 52 is attached in a known manner. A hole 54 is drilled and tapped in arm 16 having threads to receive pedal 52 therein. Notch 17 in the preferred embodiment allows for clearance for arm 16 of a decorative cover which may be placed over the mechanism. Such covers are known in the art.

Cam follower 20 is comprised of a post 21 and a roller bearing 23. Roller bearing 23 rotates freely with respect to post 21 when engaged in channel 22 of the cam 12. Post 21 is threaded so as to be screwed into an extension 56 of arm 16.

Figure 16:
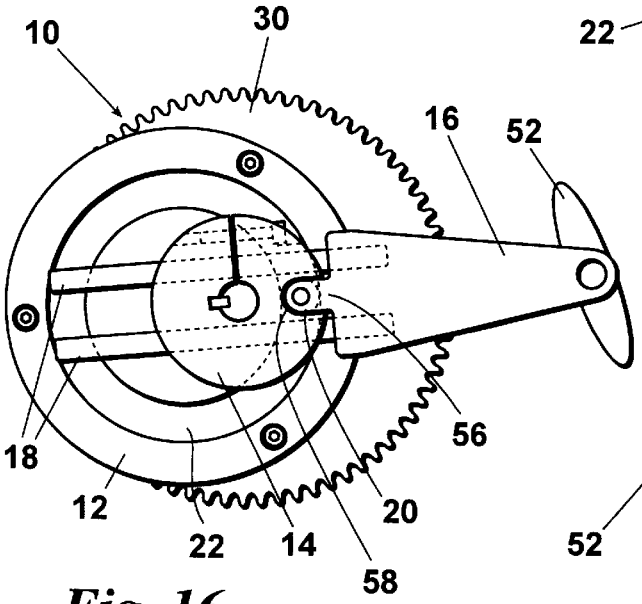
FIG. 16 is the pedal crank of FIG. 14 depicted at the point of its minimum length, rotated 180 degrees from FIG. 14.

Referring back to FIG. 5, the orientation between cam follower 20, including roller bearing 23 and post 21 and extension 56 of arm 16 may be seen. Cam followers such as cam follower 20 are commercially available. Hub 14 may further include a notch 58 machined therein wherein notch 58 is of a shape to receive cam follower 20 (and extension 56) when pedal crank 10 is in a position of its least extension (as shown in FIG. 16).

Referring back to FIGS. 1 and 2, the assembled functional relationship between the component parts of pedal crank 10 may be observed. Cam 12 is affixed to the housing or frame of the bike using set screws 36 such that in the preferred embodiment, cam 12 does not rotate. Cam follower 20 is secured within extension 56 of arm 16 so that post 21 extends roller bearing 23 into channel 22 of cam 12. Roller bearing 23 rotates within channel 22 in contact with the wall of channel 22. Rods 18 are fixed in this embodiment into arm 16 such that they are capable of extending through hub 14 via channels 50. Hub 14 is secured to axle 24 by set screws 48. Key 40 insures that hub 14 will rotate with axle 24.

Since axle 24 extends through cam 12 via eccentric hole 32, it can be seen that as arm 16 rotates with rods 18 fixed thereto and cam follower 20 extending into channel 22 of cam 12, the distance between arm 16 and hub 14 will vary by rods 18 reciprocating within channels 50 of hub 14 as arm 16 rotates around cam 12.

Figure 14:
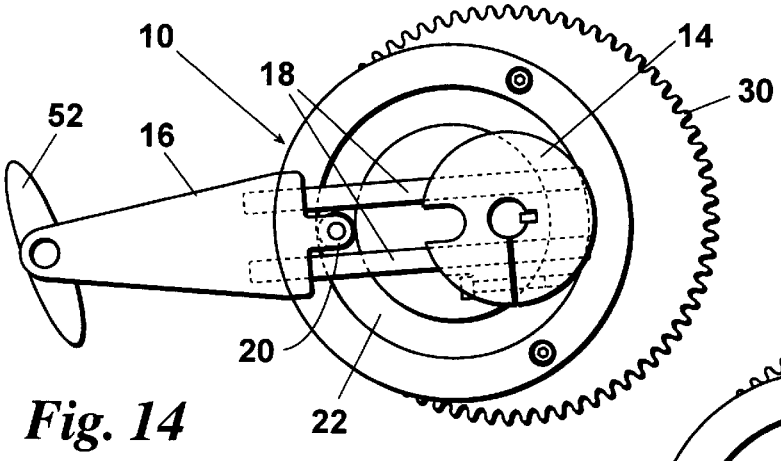
FIG. 14 is a side view of the pedal crank of the present invention depicted at the point of its maximum length.

FIGS. 14–17 depict pedal crank 10 as it rotates around cam 12. FIG. 14 depicts pedal crank 10 in substantially the same position as FIG. 1. The distance between arm 16 and hub 14 is at its maximum corresponding to the maximum length of pedal crank 10 at the point of maximum biomechanical force of the leg of the user.

Figure 15:
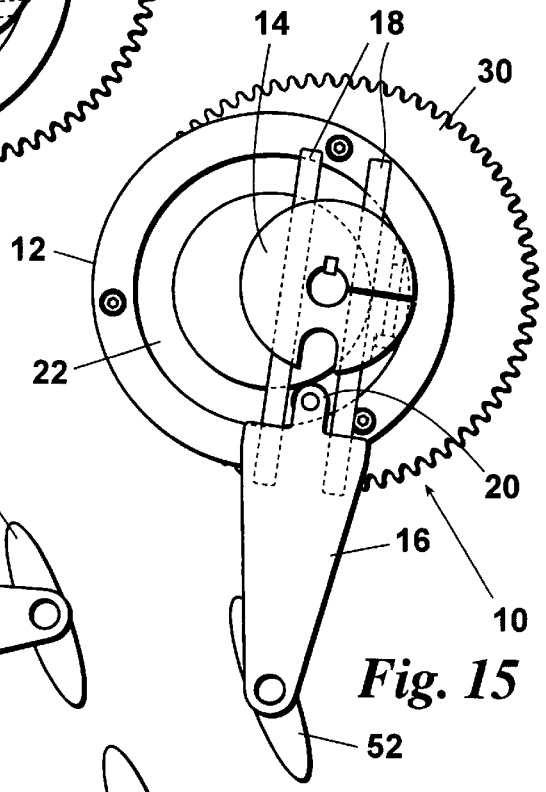
FIG. 15 is the pedal crank of FIG. 14 depicted in a position rotated 90 degrees from FIG. 14.

Moving next to FIG. 15, as pedal crank 10 is rotated such that cam follower 20 travels within channel 22 of cam 12, the eccentric position of cam 12 with respect to sprocket 30 causes rods 18 to slide within hub 14 such that a portion of rods 18 extend through hub 14.

FIG. 16 depicts the point of minimum length of pedal crank 10 corresponding to the minimum biomechanical force of the leg of the user wherein arm 16 is drawn toward such that extension 56 of arm 16 is recessed within notch 58 of hub 14. Rods 18 are shown extending through hub 14.

Figure 17:
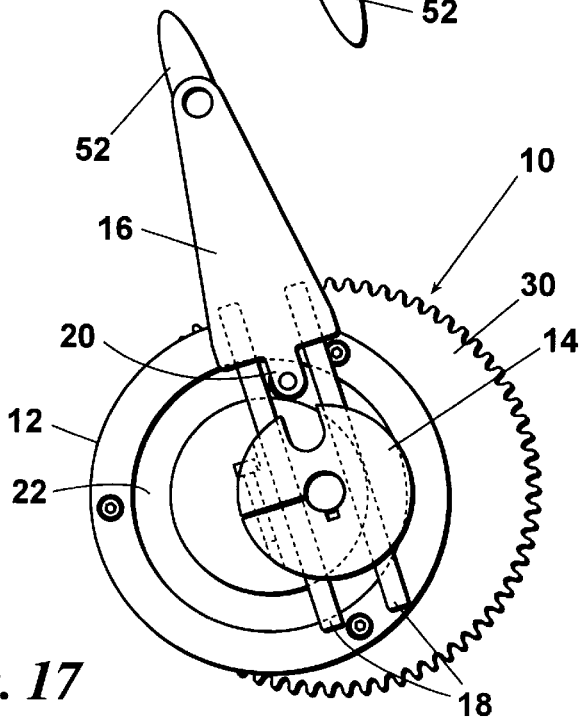
FIG. 17 is the pedal crank of FIG. 14 depicted in a position rotated 270 degrees from FIG. 14.

FIG. 17 depicts a point past the position of minimum length of pedal crank 10 such that arm 16 is drawn away from hub 14 along rods 18 caused by cam follower 20 following the shape of channel 22 within cam 12.

Figure 18:
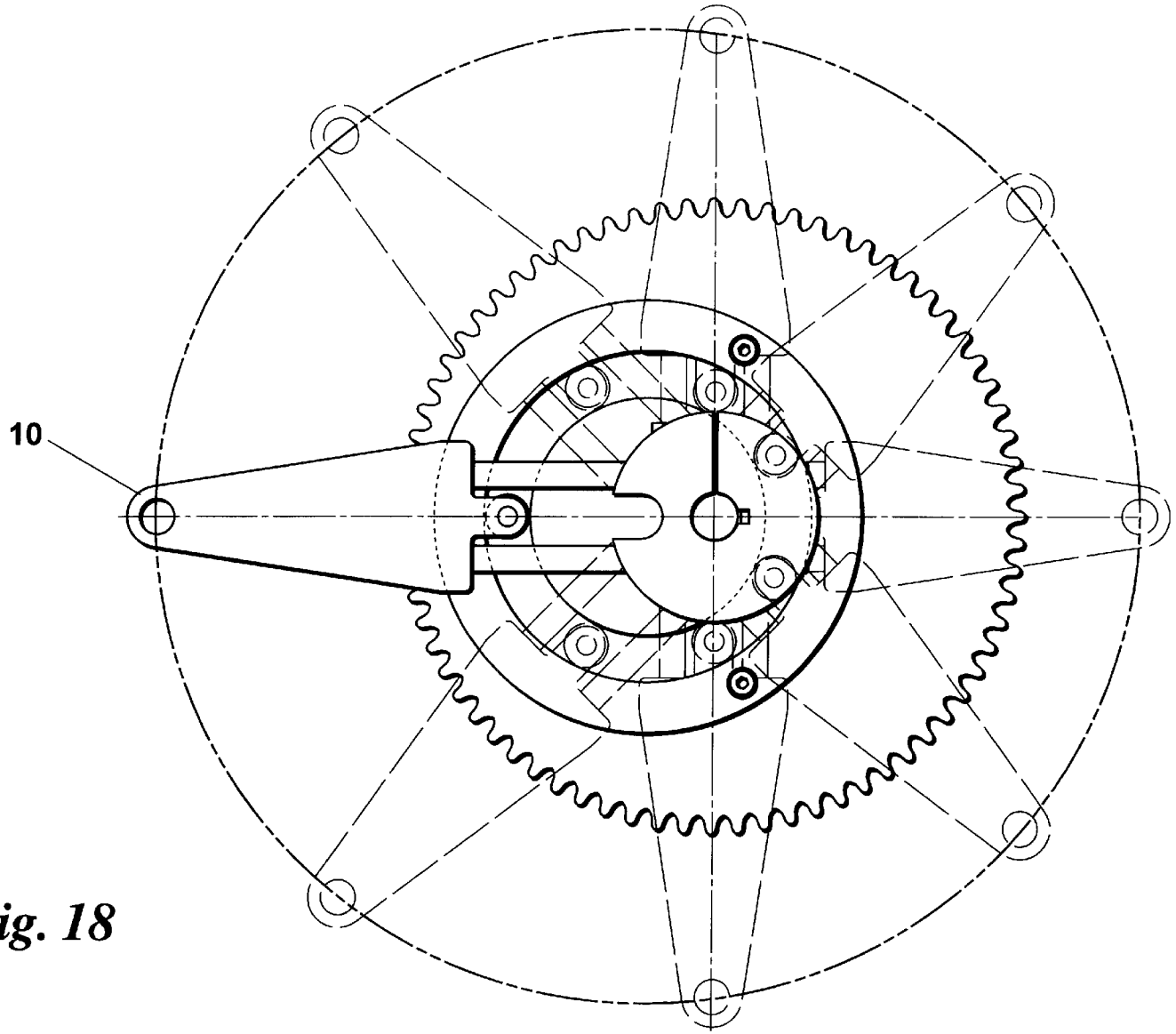
FIG. 18 is an illustration of the pedal crank of the present invention shown at every 45 degrees of rotation.

FIG. 18 depicts the alternate positions of pedal crank 10 shown at every 45° of rotation. FIG. 18 shows the general path of travel of pedal crank 10 as well as its various lengths throughout that path of travel.

Figure 19:
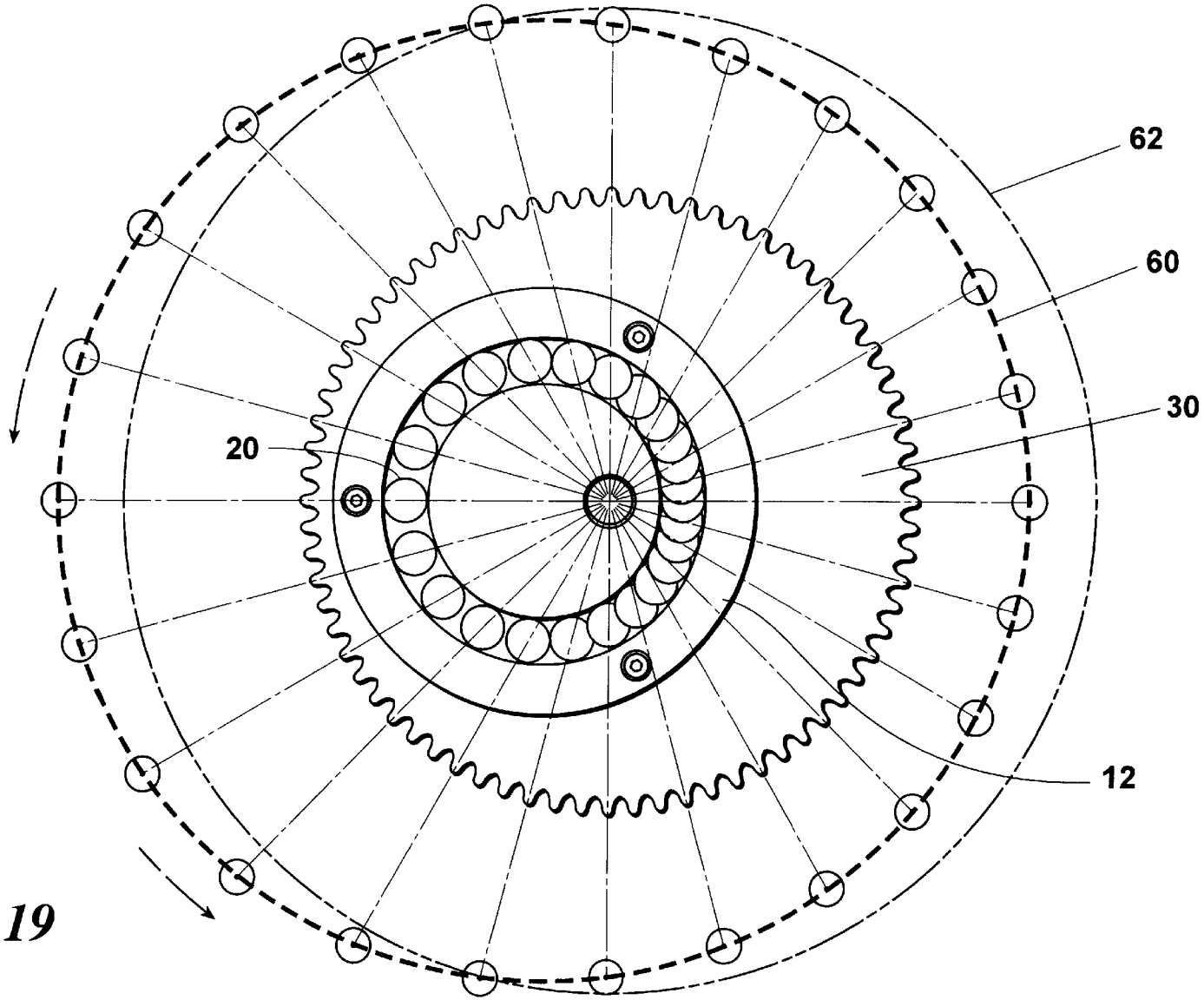
FIG. 19 is a diagrammatical illustration of the path of the pedal crank of the present invention with the crank arm shown rotated every 15 degrees and overlaid upon the circular path of the traditional fixed length pedal crank.

FIG. 19 is a graphical depiction of crank arm 16 shown at every 15° of rotation overlaid upon the circular path 60 of rotation of a fixed length of pedal crank 62.

Figure 20:
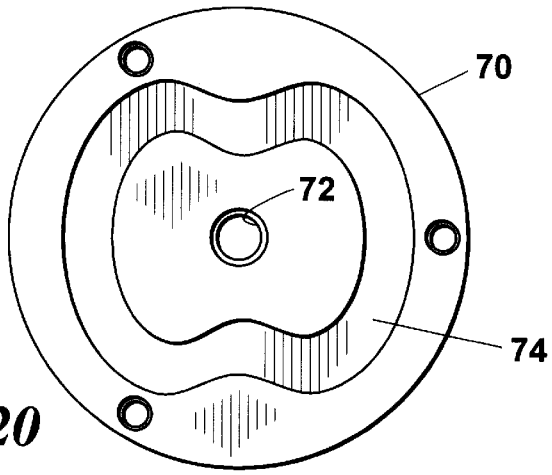
FIG. 20 is a front view of a second preferred embodiment cam wherein the holed is placed at its center and the channel is cut in a geometric pattern designed to produce an elliptical path of the crank arm.

FIG. 20 depicts a second preferred embodiment of cam 70, wherein the hole 72 is positioned at its center and channel 74 is modified so as to effect the relationship between an arm (not shown) including a cam follower which follows the path of channel 74. The particular shape of channel 74 would produce an elliptical path of travel of a pedal crank following that path.

Figure 22:
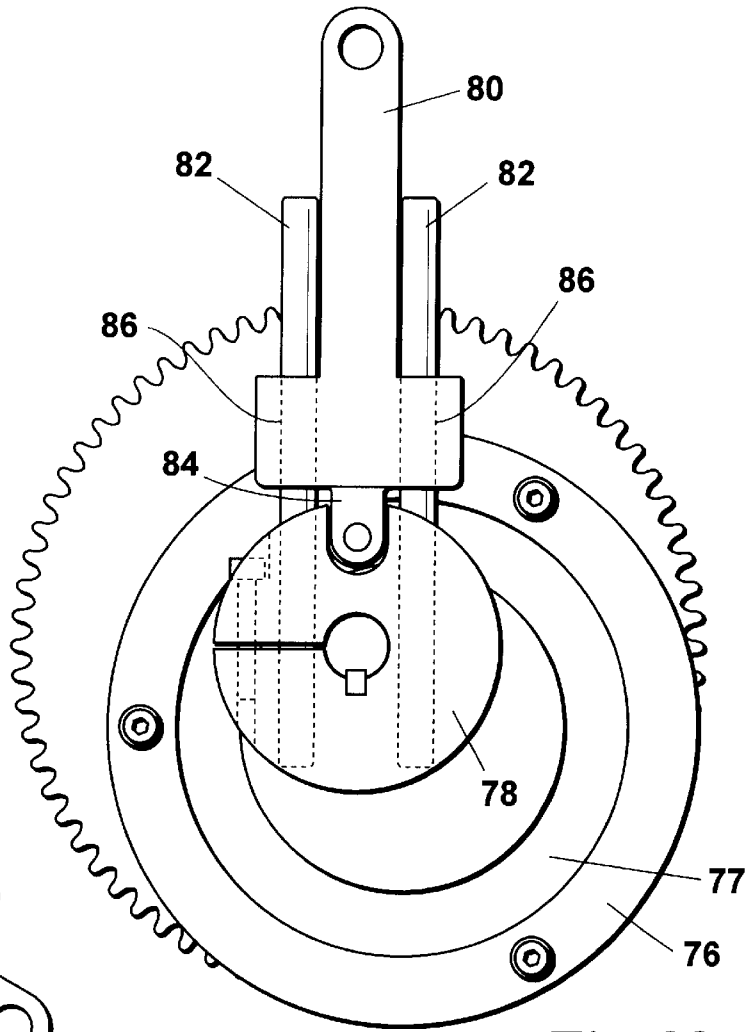
FIG. 22 is the pedal crank of FIG. 21 positioned at the point of minimum length.
Figure 21:
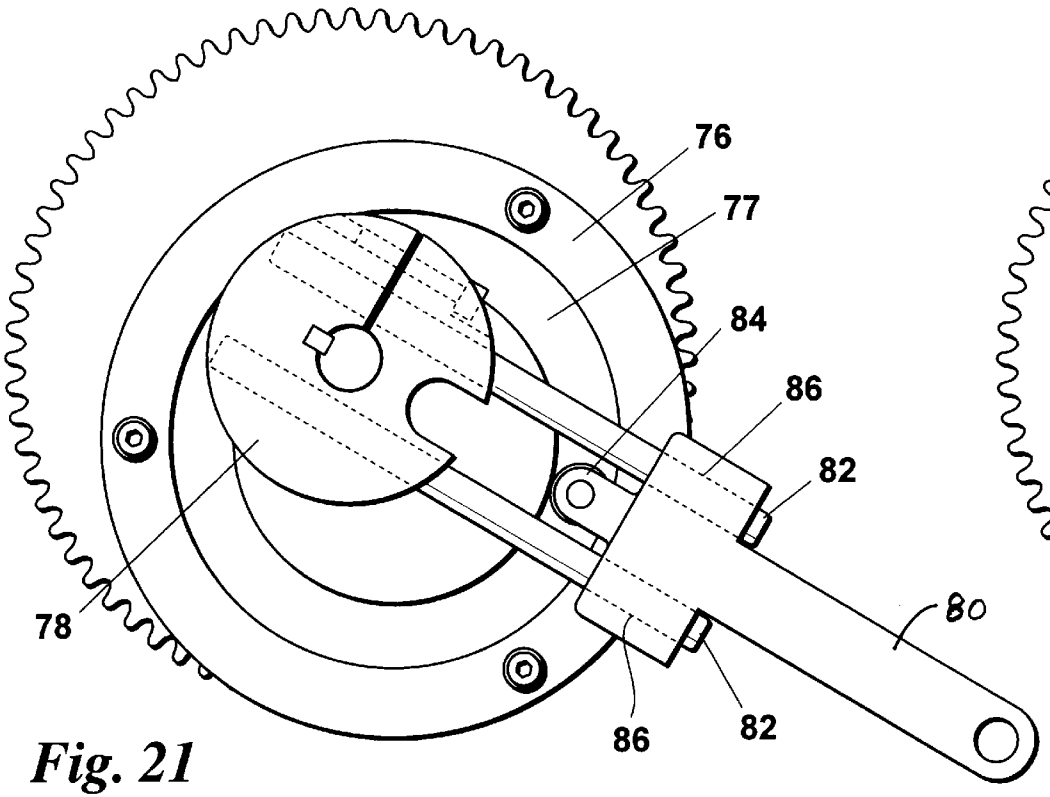
FIG. 21 is the second preferred embodiment pedal crank wherein the rods are fixed in the hub and reciprocate with respect to the crank arm and positioned at the point of maximum length.
Figure 24:
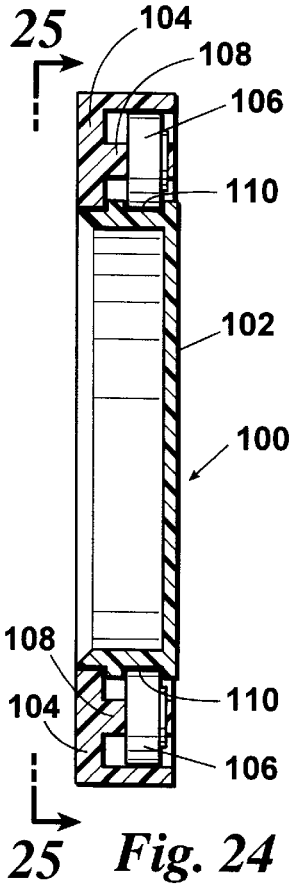
FIG. 24 is a view taken along line 24—24 of the cam of FIG. 23.
Figure 23:
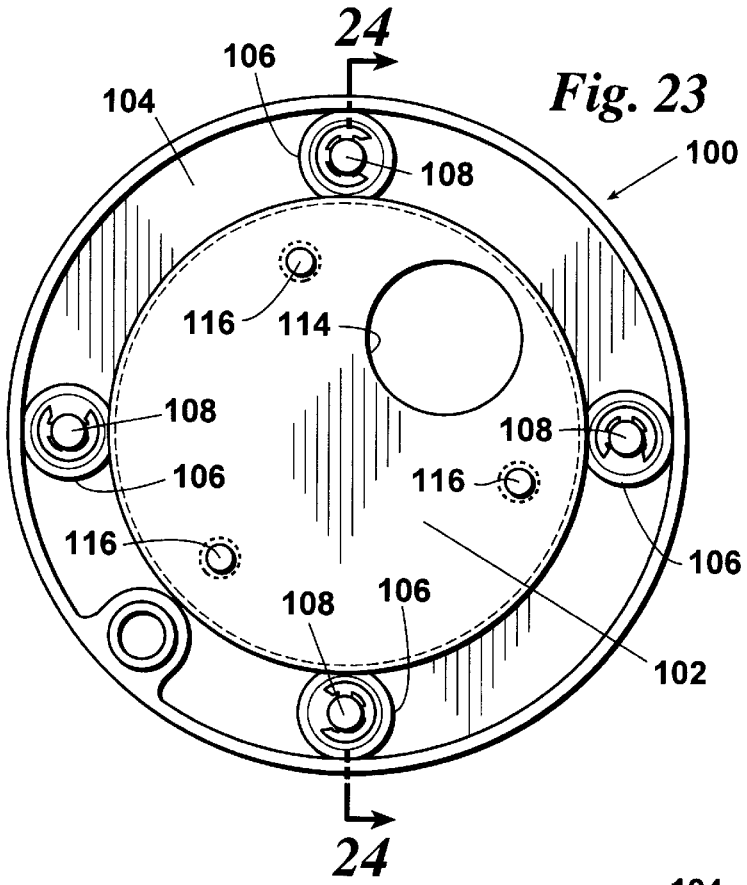
FIG. 23 is a front view of a third preferred embodiment cam.
Figure 25:
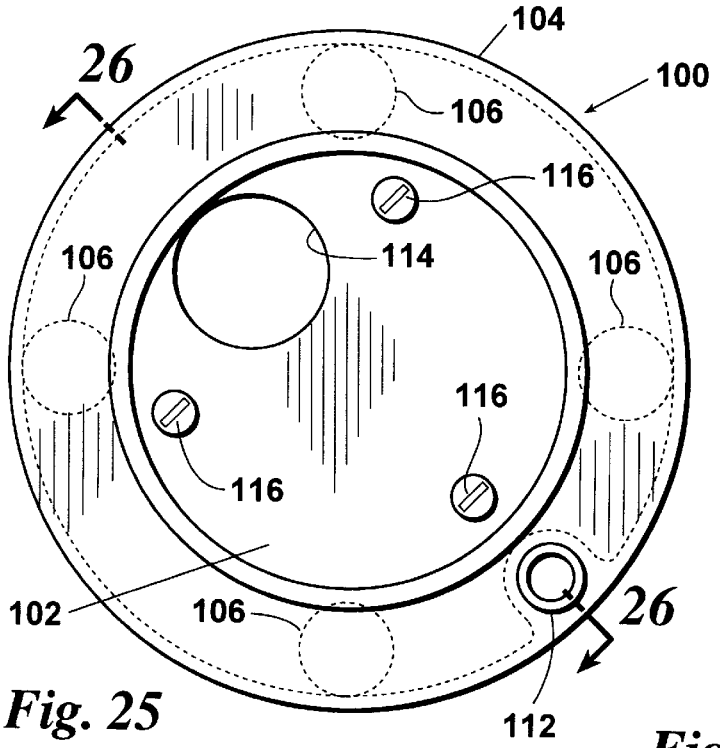
FIG. 25 is a back view of the alternate embodiment cam of FIG. 23 and taken along line 25—25 of FIG. 24.
Figure 26:
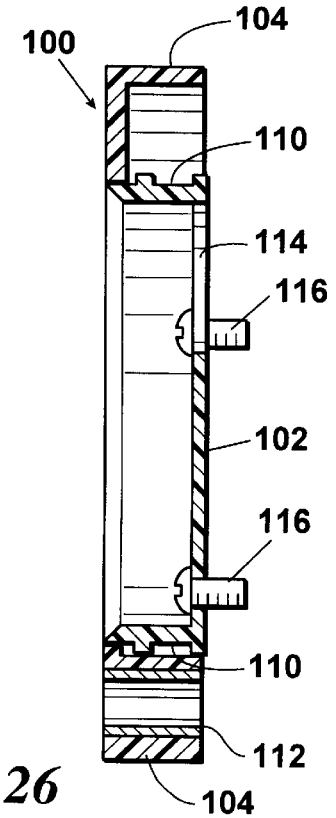
FIG. 26 is a view taken along line 26—26 of the cam of FIG. 25.

FIGS. 21 and 22 depict a second alternate embodiment pedal crank assembly including cam 76, hub 78, arm 80, rods 82, and cam follower 84. In this embodiment, the second ends of rods 82 are fixed within hub 78 and the first ends are free to reciprocate within channels 86 drilled through arm 80 as arm 80 rotates and cam follower 84 follows the path of channel 77 within cam 76. In the position of FIG. 21, arm 80 is of a maximum extension of rods 82 away from hub 78 such that the pedal crank assembly corresponds to its maximum length.

FIG. 22 depicts the pedal crank assembly of FIG. 21 except in a position where arm 80 is drawn toward hub 78 where rods 82 extend through arm 80. This figure corresponds to the point of minimum length of the pedal crank assembly and the minimum biomechanical force of the user.

Pertaining to the third preferred embodiment of the present invention, reference is made to FIGS. 23–26 in combination with FIG. 1. Referring to FIG. 1, cam 12 may also be replaced in a third embodiment with the cam of FIGS. 23–26. In this embodiment, with reference to FIG. 23, cam 100 is comprised of a plate 102 secured within a ring 104 such that ring 104 is capable of rotation with respect to plate 102. A plurality of roller bearings, collectively 106, secured onto posts 108 on ring 104 (FIG. 24), engage the outer circumference of plate 102 and are capable of rotation therewith within a channel 110 (FIG. 26) on the circumference of plate 102.

In this third embodiment, cam follower 20 (of FIG. 1) is a machined post. A bearing 112 which could be a composite bearing or a needle bearing is fixed within ring 104 to receive the post extending from arm 16 (FIG. 1). The post is shaped and sized to mate bearing 112. Bearing 112 allows the post to rotate within ring 104.

A hole 114, sized to fit over axle 24 (FIG. 1) is drilled through plate 102. Hole 114 is eccentric in that its center does not align with the center of plate 102. A bearing may be placed in hole 114 between plate 102 and axle 24 to allow free rotation of axle 24 within plate 102.

Plate 102 is secured to the housing or frame of the bike using screws 16 extending through plate 102. Since plate 102 is fixed, arm 16, including a post extending into bearing 112 in ring 104, follows the circular shape of ring 104 as ring 104 rotates about plate 102 between bearings 106. In this third embodiment, the pedal crank would then follow the same path as disclosed in FIGS. 18 and 19.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A pedal crank assembly for use with an exercise machine including a shaft, comprising:

a cam adapted to be secured to the exercise machine and including a channel therein;

said cam including a hole capable of receiving the shaft;

a hub adapted to be fixed to the shaft and capable of rotation therewith;

an arm;

a cam follower operable with said arm to engage said channel and travel therein;

at least one rod having a length extending at least partially into and between said arm and said hub;

wherein the distance between said hub and said arm can be varied by said length of said at least one rod;

said hub including at least one channel extending therein;

said at least one rod including a first end and a second end;

said second end of said at least one rod being fixed in said hub;

said arm having at least one channel extending therethrough; and said first end of said at least one rod extending through said at least one channel in said hub such that said length of said at least one rod is capable of reciprocating within said at least one channel of said arm.

2. The pedal crank assembly of claim 1 further comprising:

said cam including a center point;

said hole in said cam being eccentric from said center point of said cam;

said channel including a substantially annular geometry.

3. The pedal crank assembly of claim 1 wherein a bearing is inserted in said at least one channel in said arm between said arm and said at least one rod.

4. The pedal crank assembly of claim 3 wherein said bearing is a linear bearing.

5. The pedal crank assembly of claim 1 including two rods.

6. The pedal crank assembly of claim 1 wherein said cam follower extends from said arm and into said channel.

7. The pedal crank assembly of claim 1 wherein said cam follower comprises:

a post secured to said arm and extending therefrom;

a roller bearing secured to said post extending into said channel and capable of rotation therein.

8. The pedal crank assembly of claim 1 including a pedal affixed to said arm.

9. The pedal crank assembly of claim 1 further including a bearing pressed in said hole in said cam.

* * * * *